United States Patent [19]

Porter, Jr.

[11] Patent Number: 5,014,591

[45] Date of Patent: May 14, 1991

[54] MULTIPLE ENCODER FUZE

[75] Inventor: Frank K. Porter, Jr., Billerica, Mass.

[73] Assignee: Raytheon Company, Lexington, Mass.

[21] Appl. No.: 459,617

[22] Filed: Jan. 2, 1990

[51] Int. Cl.[5] ..... F42C 9/14; F42C 17/00

[52] U.S. Cl. ..... 89/6; 102/270

[58] Field of Search ..... 89/6, 6.5; 102/270, 102/265, 271

[56] References Cited

U.S. PATENT DOCUMENTS

| | | | |
|---|---|---|---|
| 3,977,329 | 8/1976 | Wilde | 102/270 |
| 4,072,108 | 2/1978 | Lewis et al. | 89/6 |
| 4,594,944 | 6/1986 | Rongus et al. | 89/6 |
| 4,750,424 | 6/1988 | Hau | 102/221 |
| 4,779,533 | 10/1988 | Winterhalter et al. | 89/6 |

*Primary Examiner*—David H. Brown

*Attorney, Agent, or Firm*—Donald F. Mofford; Richard M. Sharkansky

[57] ABSTRACT

A time delay mechanism force fuze wherein the mechanism comprising an encoder ring, having an inner surface with a predetermined mask pattern of lands and grooves, is locked by a spring lock exerting pressure in a radially outward motion, thus enhanced when the fuze is exposed to the influence of dynamic forces from a gun, is shown. The spring lock cooperates with a lock pin such that a radially inward deflection of the lock pin deflects the spring lock so that the encoder ring with a reaction surface is unlocked and can be fully rotated by a setting collar acting through a detent spring on the reaction surface. If the encoder ring is locked, the detent spring is deflected over the reaction surface of the encoder ring when the setting collar is rotated, thereby preventing the encoder ring from being changed. A plurality of actuators, which determines a digital word that represents a length of time for a time delay in a digital timing circuit for the fuze, is actuated by the predetermined mask pattern. The digital word is changed by rotating the setting collar while the encoder ring is unlocked.

11 Claims, 6 Drawing Sheets

50
508
521
522
523
525
526
527
510
512
513
514
515
516
517
518
519
52
509
530
532
533
536
537
TO DIGITAL CIRCUITRY

MULTIPLE ENCODER FUZE

This invention was made with Government support under Contract No. DAAK21-83-C-0012 awarded by the Department of the Army.

BACKGROUND OF THE INVENTION

This invention pertains generally to fuzes for artillery projectiles, and particularly to an encoder for a fuze capable of providing a multiple of discrete timing settings in a single revolution of a setting collar.

As is known, it is often necessary to delay the arming of an artillery projectile after firing. In a changing battlefield, the capability to change the length of the delay quickly and easily may determine the outcome of the battle. It is desirable to provide a fuze for an artillery projectile with a multiple of discrete timing settings thereby providing greater flexibility while minimizing the number of components in the fuze. A problem arises in the operation of known fuzes because of inadvertent resetting of the fuze when handling the projectile for the purpose of gun loading. Also known fuzes are apt to reset due to the inertial effects upon the setter locks of the fuze during the influence of the dynamic forces of the gun.

SUMMARY OF THE INVENTION

With the foregoing background of this invention in mind, it is a primary object of this invention to provide, for an artillery projectile, a fuze with an encoder having a multiple of discrete timing settings in a single revolution of a setting collar.

Another object of this invention is to provide a fuze which is adapted to reduce the inertial effects upon the setter locks of a fuze during the influence of dynamic forces from a gun.

Still another object of this invention is to provide a fuze which is adapted to reduce the possibility of resetting the time delay of the fuze when handling the projectile for the purpose of gun loading.

A still further object of this invention is to provide a fuze with an arrangement of components resulting in simplified assembly procedures in production.

The foregoing and other objects of this invention are met generally by a contemplated fuze wherein an encoder comprising an encoder ring, having an inner surface with a predetermined mask pattern, is locked by a spring lock exerting pressure in a radially outward motion, thus enhanced when the fuze is exposed to the influence of dynamic forces from a gun. The spring lock cooperates with a lock pin such that a radially inward deflection of the lock pin deflects the spring lock so that the encoder ring with a reaction surface is unlocked and can be fully rotated by a setting collar acting through a detent spring on the reaction surface. If the encoder ring is locked, the detent spring is deflected over the reaction surface of the encoder ring when the setting collar is rotated, thereby preventing the encoder ring from being changed. A plurality of actuators, which determine a digital word that represents a length of time for a time delay in a digital timing circuit for the fuze, is actuated by the predetermined mask pattern. The digital word is changed by rotating the setting collar while the encoder ring is unlocked.

BRIEF DESCRIPTION OF THE DRAWINGS

For a more complete understanding of this invention reference is now made to the following description of the accompanying drawings, wherein.

DESCRIPTION OF THE PREFERRED EMBODIMENTS

Figure 1:
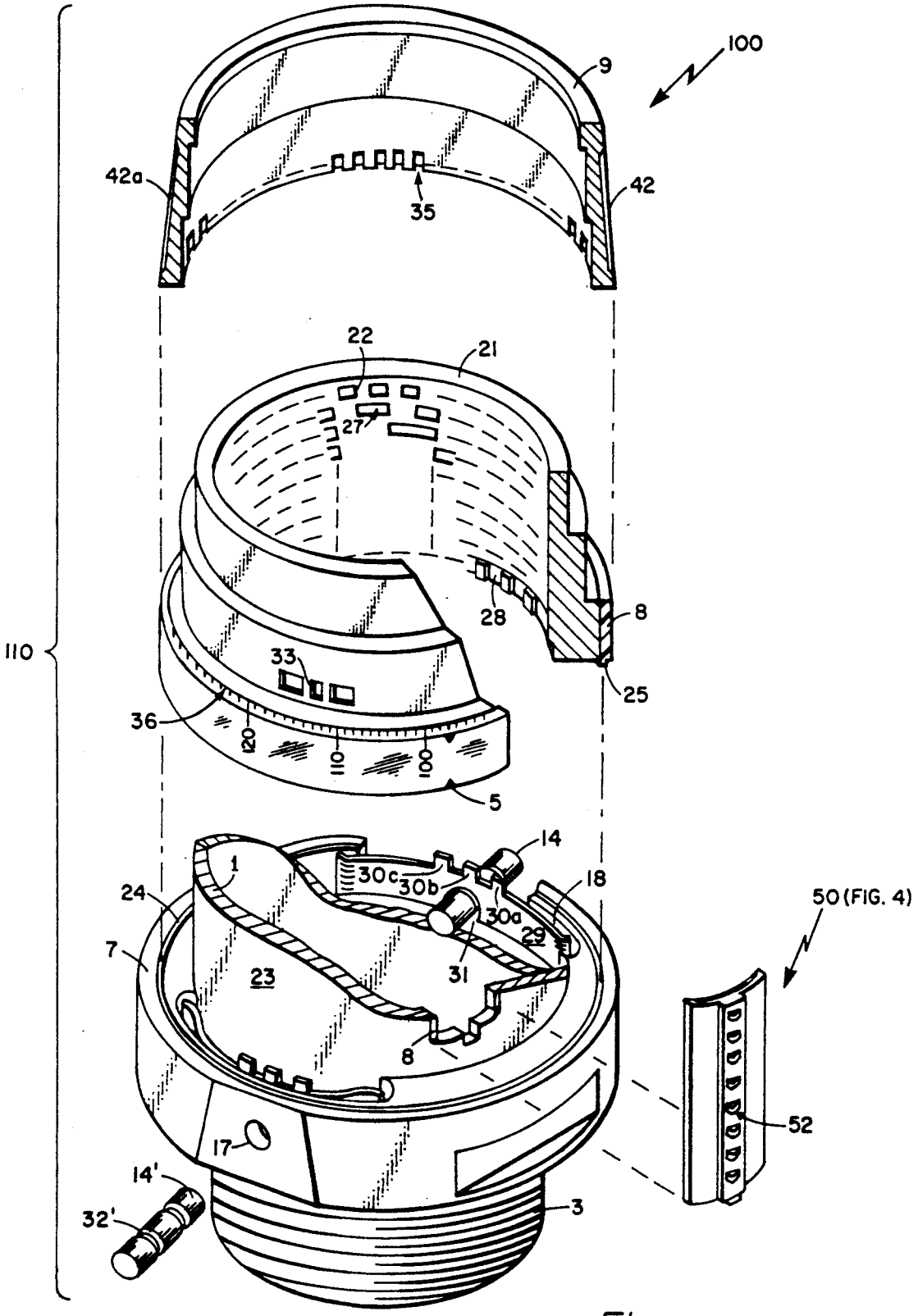
FIG. 1 is an isometric view, exploded and partially torn away, showing various elements of the encoder according to the invention.

Referring now to FIG. 1, a head 100 of an artillery projectile (not shown) with a portion broken away is shown with a fuze encoder 110 according to this invention. The artillery projectile (not shown) is either a non-spinning or spin stabized projectile shot from a gun. A fuze base 1 with interface thread 3 is used to attach head 100 to the artillery projectile (not shown) by screwing the head 100 to the artillery projectile. Fuze encoder 110 is shown to comprise lock pin 14' and lock pin 14 with associated components (not numbered). Since the associated components (not numbered) used with lock pin 14 are the same as the associated components (not shown) used with lock pin 14', only the associated components (not numbered) used with lock pin 14 are described in detail. Fuze encoder 110 includes fuze shelf 7, lock pin 14, annular groove 18, spring lock 29, encoder ring 21, encoder mask 22, locking teeth 28, window 8 detent spring 16 (FIG. 3), setting collar 9, reaction surface 35, flute 42 and encoding switch assembly 50.

The fuze shelf 7 is provided on the fuze base 1 to support encoder ring 21, window 8 and setting collar 9, which are mounted encircling cylindrical surface 23 of fuze base 1. The window 8, having a circumferential shape and an extended skirt 25, is secured to the fuze shelf 7 by any known means, such as by epoxying the extended skirt 25 to a mating groove 24 in the fuze shelf 7. A radial bore 17 extending through the fuze shelf 7 is provided to accommodate lock pin 14. The annular groove 18 is provided in the shelf 7 of sufficient depth to intersect the bore 17 and continues an equal distance radially from the bore 17. Inserted in the bore 17 is the lock pin 14 with an elastomeric seal such as a 0-ring (not shown) which, while maintaining a seal, allows motion of the lock pin 14 relative to the fuze shelf 7. In the local area of the lock pin 14 the outer contour of the fuze shelf 7 and the window 8 are relieved to permit manual deflection of the lock pin 14 radially inward, while the lock pin 14 is prevented from extending outward beyond the original contour of the fuze shelf 7. The spring lock 29 is inserted in the annular groove 18. A recess 31 in spring lock 29 engages a control groove (not shown) in lock pin 14 which is similar to control groove 32' shown in lock pin 14'. The spring lock 29 exerts radial force outward upon lock pin 14. Lock tangs 30*a*, 30*b* and 30*c* on the spring lock 29 engage locking teeth 28 on encoding ring 21.

The encoder ring 21 is shown having a varying vertical cross-section and includes two slots as typified by slot 33. The encoder mask 22 with a predetermined mask pattern 27 of lands and grooves is disposed on an inner surface of the encoding ring 21. The lands and grooves (not numbered) activate switches, such as actuator 509, (FIG. 4), forming a mechanical read only memory as described hereinafter. The predetermined mask pattern 27 is aligned with the locking teeth 28 which are facing inward on encoding ring 21. A predetermined scale 36 is disposed on the periphery of the encoder ring 21. Here the scale represents time in seconds but could also represent other parameters for the fuze encoder. Each element (not numbered) of the scale 36 has a corresponding element in the predetermined mask pattern 27 and is aligned with each corresponding element of mask pattern 27.

Figure 2:
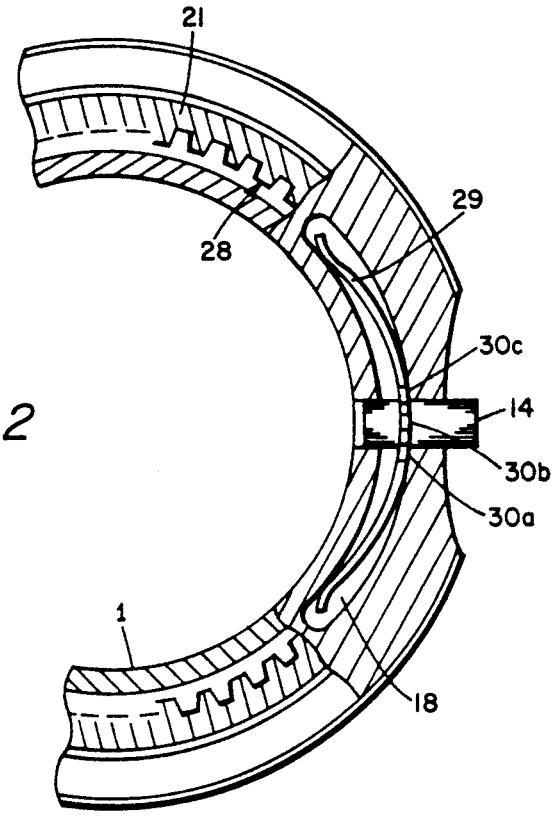
FIG. 2 is a cross-sectional view, partially torn away, showing a lock pin cooperating with a spring lock and locking teeth.

Referring now to FIG. 2, encoder ring 21 is placed over cylindrical surface 23 (FIG. 1) of base 1 such that the encoder ring 21 is supported by fuze shelf 7 (FIG. 1), and lock tangs 30*a*, 30*b* and 30*c* engage locking teeth 28. When lock pin 14 is depressed radially inward, the lock tangs 30*a*, 30*b* and 30*c* on spring lock 29 are disengaged from locking teeth 28, thereby permitting rotation of encoder ring 21.

Figure 3:
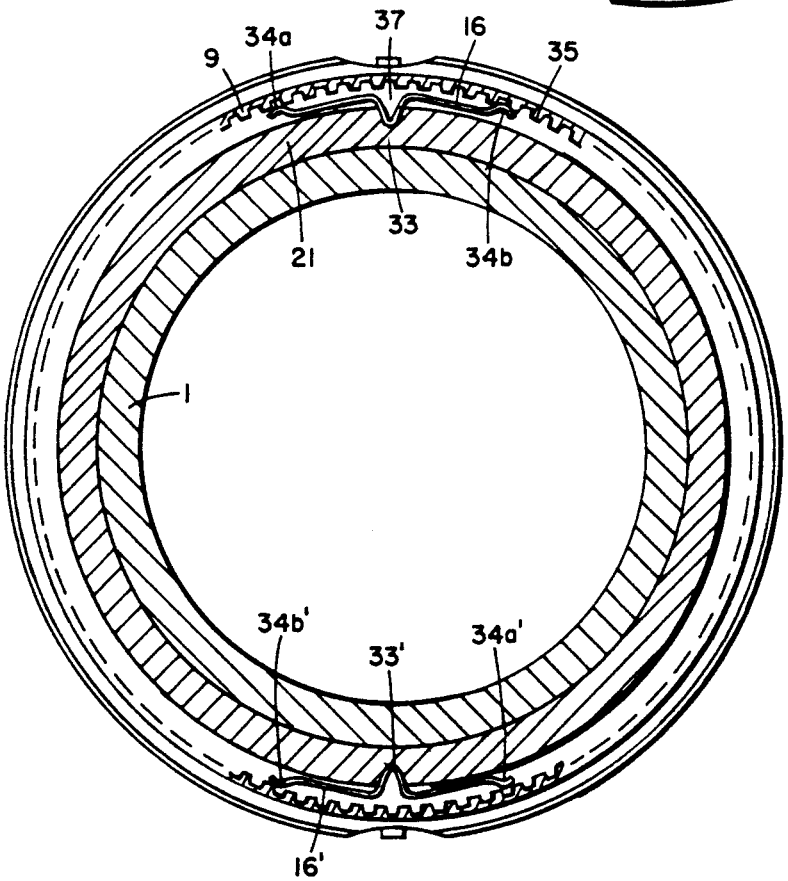
FIG. 3 is a cross-sectional view showing a detent spring reacting with a setting collar and the encoder ring.

Referring to FIG. 3, detent spring 16 is inserted into a space 37 between the encoder ring 21 and the setting collar 9. As shown in FIG. 1, the setting collar 9 has a cross-section loosely conforming internally to the encoder ring 21 and conforming externally to the aerodynamic profile of the head 100 (FIG. 1). Flutes as typified by flute 42 and flute 42*a* (FIG. 1), are provided using indented surfaces on the external surface of setting collar 9 to facilitate positive gripping of the setting collar 9 by a user (not shown). The setting collar 9 employs an upper collar seal (not shown) and a lower collar seal (not shown) such as an O-ring, both having elastomeric properties, at the upper and lower circular interfaces, respectively, to protect the components (not numbered) of the fuze encoder 110 from external environments.

Slots 33 and 33' are respectively provided in the encoder ring 21 to maintain the detent spring 16 and an opposing detent spring 16' in a fixed position in relation to the encoder ring 21. Spring ends 34*a* and 34*b* on detent spring 16 interact with reaction surface 35 which is a feature provided on the inner surface of the setting collar 9. In a similar manner, spring ends 34*a'* and 34*b'* on detent spring 16' interact with reaction surface 35 so that as setting collar 9 is rotated around fuze base 1, encoder ring 21 is rotated correspondingly. When encoder ring 21 is locked, thereby preventing the encoder ring 21 from rotating, spring ends 34*a*, 34*b*, 34*a'* and 34*b'* slip over reaction surface 35 which alleviates the force presented on encoder ring 21 when setting collar 9 is rotated around fuze base 1.

Referring again to FIG. 1, encoder switch assembly 50 includes a plurality (here 8) of wireform actuators 52. Encoder switch assembly 50 is shaped as shown loosely conforming to the cylindrical surface 23 of fuze base 1. The plurality of wireform actuators is connected to circuitry (not shown) which is to be described hereinafter. Encoder switch assembly 50 is mounted in a recess 8 in fuze base 1. The encoder switch assembly 50 is mounted so that each one of the plurality of wireform actuators 52 is aligned with a corresponding element (not numbered) of the predetermined mask pattern 27 providing a mechanical read only memory (not numbered). The encoder ring 21 and encoder switch assembly 50 provide a time delay section (not numbered) in the head 100 of the artillery projectile.

Figure 4:
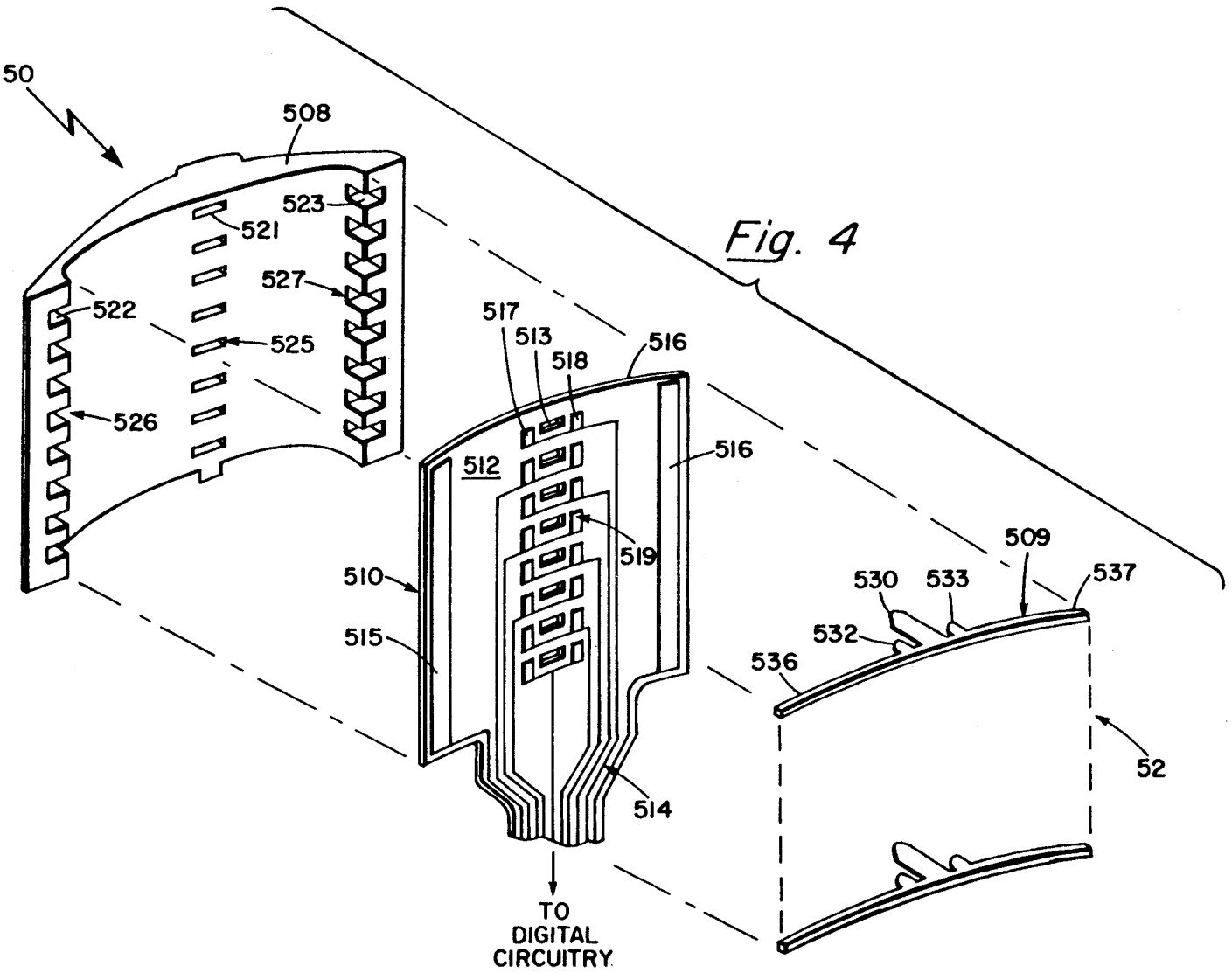
FIG. 4 is an isometric view, exploded, showing various elements of an encoder switch assembly.

Referring now to FIG. 4, the encoder switch assembly 50 is shown to include a spring index plate 508, a flexprint assembly 510 and the plurality of actuators 52 as typified by actuator 509. Spring index plate 508, having a first and a second surface, is shaped with the first surface having a contour loosely matching the contour of cylindrical surface 23 (FIG. 1) of fuze base 1 (FIG. 2) and with the second surface having a chamber for accommodating the flexprint assembly 510, as described hereinafter. Additionally, spring index plate 508 has a plurality of slots 525 and grooves 526 and 527 for supporting the plurality of actuators 52. Actuator 509, having a center and a first end 536 and a second end 537 and typical of each one of the plurality of actuators 52, has a flange 530 at the center of the actuator 509. Next to one side of flange 530 on actuator 509 is a first contact 532 and next to an opposing side of flange 530 is a second contact 533 providing a pair. When encoder switch assembly 50 is assembled, flange 530 is set in slot 521 which is one of the plurality of slots 525. Additionally, the first end 536 of actuator 509 is mated with groove 522 which is one of the plurality of grooves 526 and the second end 537 of actuator 509 is mated with groove 523 which is is one of the plurality of grooves 527. Local deformation or any other known means in each of the plurality of grooves 526 and 527 lock each one of the plurality of actuators 52 in place.

Flexprint assembly 510 comprises a nonconducting material 512 having a surface shaped as shown, which fits in the chamber of spring index plate 508 and attached in any known means, such as by epoxying. Conductive circuitry 514, capable of conducting electric current, is disposed on the surface of the nonconducting material 512. The conductive circuitry 514 includes common contact surfaces 515 and 516 and a plurality of pairs 519 of contact pads as typified by contact pad 517 and contact pad 518. Between each one of the pairs 519 of contact pads is a hole, as typified by hole 513, extending through the nonconducting material 512 and capable of allowing a corresponding flange, as typified by flange 530, of one of the plurality of actuators 52 to pass through. Contact pad 517 and contact pad 518 are dimensioned such that when flange 530 is placed through hole 513, contact pad 517 is resting against contact 532 of actuator 509 and contact pad 518 is resting against contact 533 of actuator 509.

Common contact surfaces 515 and 516 are disposed on flexprint assembly 510 and dimensioned so that a first end, such as first end 536, of each one of the plurality of actuators 52 rests against the common contact surface 515 and a second end, such as second end 537, of each of the plurality of actuators 52 rests against the common contact surface 516. If common contact surfaces 515 and 516 are connected to ground, then by opening or closing a connection made by each one of the plurality of pairs 519 of contacts pads and the corresponding contacts of one of the plurality of actuators 52, a switch is created and a one or a zero can be represented for a bit in a digital word. As in each of the actuators 52, by having contact pads 517 and 518 making a connection, in parallel, to contacts 532 and 533, respectively, a connection is ensured since if either contact pad 517 or 518 loses connection with contact 532 or 533, respectively, the remaining contact pad and contact are still connected.

In assembly, flexprint assembly 510 is mounted in the chamber of spring index plate 508, and attached by any known means. Actuator 509 is secured to spring index plate 508 by placing flange 530 through hole 513 and slot 521, mounting first end 536 in groove 522 and mounting second end 537 in groove 523. Each of the remaining plurality of actuators 52 is secured to spring index plate 508 in a like manner, creating a plurality of switches for selecting a digital word.

Figure 5:
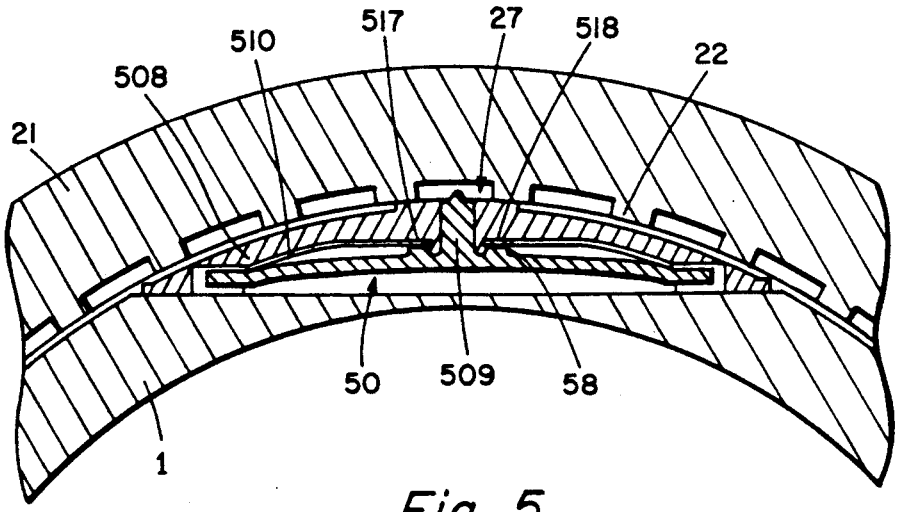
FIG. 5 is a cross-sectional view of a single actuator interacting with a predetermined mask pattern in the encoder ring.

Referring now to FIG. 5, actuator 509, typical of each of the plurality of wireform actuators 52 (FIG. 4), is shown with a contact 58 in the closed position, thereby closing a circuit (not shown). As the encoder ring 21 with code mask 22 is rotated around fuze base 1, the predetermined mask pattern 27 of lands and grooves will either push on actuator 509 thereby breaking contact 58, or not push on actuator 509, thereby closing contact 58, depending upon the position of code mask 22. Letting each of the plurality of wireform actuators 52 represent a bit in a digital word, it should be apparent to one of skill in the art that with eight actuators an 8 bit digital word can be provided. The predetermined mask pattern 27 of lands and grooves on encoder ring 21 selectively actuates the eight actuators (not shown) so that the predetermined mask pattern 27 of lands and grooves provides a mechanical read only memory map such that each element of the predetermined mask pattern 27 selects a corresponding digital word. It should be noted that centrifrugal spin force is in the same direction as the spring force which closes the contact 58 of actuator 509. Spin force thereby adds to the constant pressure, increasing the assurance of closure.

Referring again to FIG. 1, it should be apparent that locking teeth 28 determine the number of increments possible as encoder ring 21 makes one revolution. In the embodiment shown, there are eighty teeth so that eighty settings are possible. Although the encoder switch assembly 50 (FIG. 4) has a capacity of 256 settings, the number of settings is controlled by the number of locking teeth 28.

It will now be apparent to one of skill in the art that the inward deflection of the lock pin 14 displaces spring lock 29, thereby disengaging lock tangs 30*a*, 30*b* and 30*c* from locking teeth 28 on encoder ring 21. Rotation of the setting collar 9 causes coaxial rotation of the encoder ring 21 reacting through detent spring 16, which is possible because the locking teeth 28 are free from the lock tangs 30*a*, 30*b* and 30*c*. The setting collar 9 is rotated until the user (not shown), viewing through window 8 at an index 5, selects an appropriate element of the scale 36. The foregoing action selects the corresponding element of the mask pattern 27 which selectively actuates the mechanical read only memory (not numbered) for setting the time delay of the head 100. Release of the lock pin 14 will cause the lock tangs 30*a*, 30*b*, and 30*c* to engage the locking teeth 28 of the encoder ring 21 as the spring lock 29 is defected radially outward. Rotation of the setting collar 9, while the lock tangs 30*a*, 30*b* and 30*c* are engaged with locking teeth 28, will cause deflection of the spring ends 34*a*, 34*b*, 34*a*' and 34*b*' (FIG. 3) so that no reaction is allowed to transfer rotation to the encoder ring 21. The latter prevents a prior setting from being changed by an unintentional setting collar change.

Figure 6:
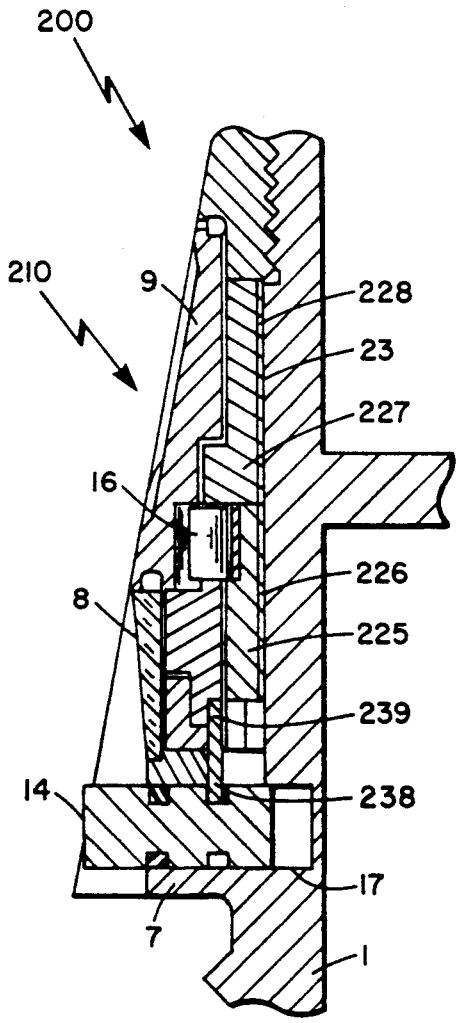
FIG. 6 is a cross-sectional diagram of a section of the encoder according to the second embodiment of the invention.

Referring now to FIG. 6, a head 200 with a dual encoder 210 according to a second embodiment of this invention is illustrated to include elements as in the first embodiment including fuze base 1, fuze shelf 7, window 8, setting collar 9, lock pin 14, and detent spring 16 with all their attendant features and functions. In the geometric space occupied by the encoding ring 21 (FIG. 1) and code mask 22 (FIG. 1) in the first embodiment are a concentric pair of encoder rings: Coarse encoder ring 225 with a coarse code mask 226 and vernier encoder ring 227 with a vernier code mask 228.

The fuze shelf 7 is formed on the fuze base 1 to support coarse encoder ring 225 and window 8 which are mounted around cylindrical surface 23 of fuze base 1. Window 8 is secured to fuze shelf 7 as disclosed hereinbefore in the first embodiment. Vernier encoder ring 227 is supported by coarse encoder ring 225 and encircles coarse encoder ring 225 below detent spring 16 and encircles cylindrical surface 23 of fuze base 1 above the detent spring 16. Coarse encoder ring 225 is divided into a plurality of coarse settings (here 50 settings) as determined by the number of coarse locking teeth 236 (FIG. 7) on coarse encoder ring 225. Each one of the coarse locking teeth 236 (FIG. 7) has a corresponding coarse encoder setting 262 (FIG. 7) which is displayed in window 8. Coarse code mask 226, which is formed as part of coarse encoder ring 225, has a predetermined mask pattern (not shown) forming a mechanical read only memory map on the inner surface of coarse encoder ring 225 which activate actuators (not shown) protruding beyond cylindrical surface 23 of fuze base 1.

Vernier encoder ring 227 is divided into a plurality of vernier settings (here 100 settings) as determined by fine locking teeth 237 (FIG. 7) on vernier encoder ring 227. Each one of the fine locking teeth 237 (FIG. 7) has a corresponding vernier encoder setting 264 (FIG. 7) which is displayed in window 8. Vernier code mask 228 which is formed as part of vernier encoder ring 227 has a predetermined mask pattern (not shown) forming a mechanical read only memory map on the inner surface of the vernier encoder ring 227 which activates actuators (not shown) protruding beyond cylindrical surface 23 of fuze base 1.

Figure 8:
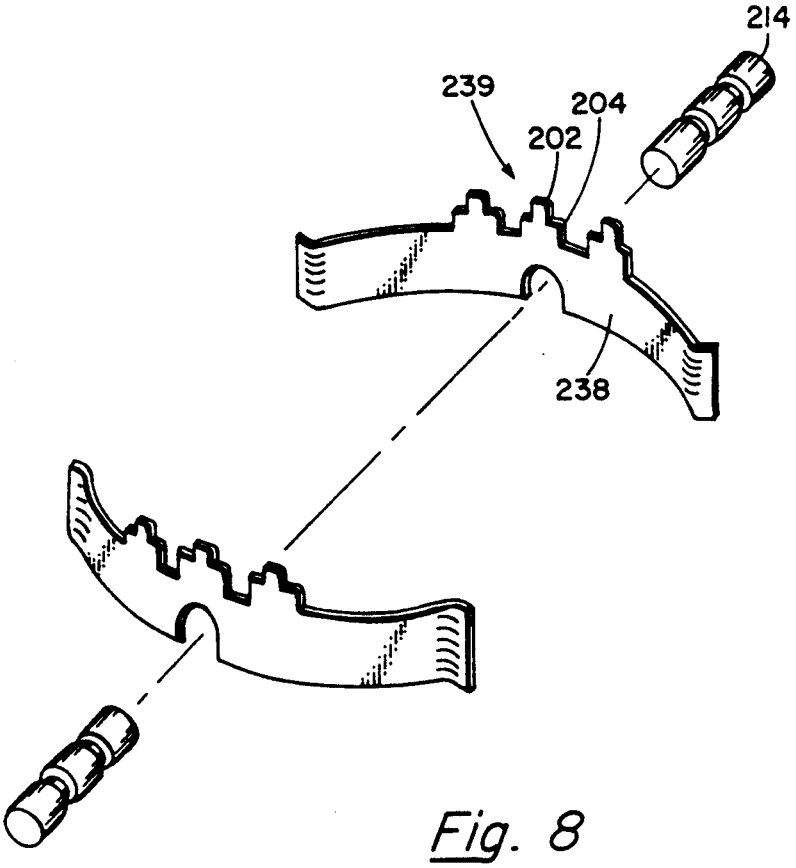
FIG. 8 is an isometric view of a lock spring and a lock pin according to the second embodiment of the invention.

Referring now to FIG. 8, spring lock 238 cooperates with lock pin 14 as spring lock 29 (FIG. 2) cooperated with lock pin 14 as described hereinbefore. In this second embodiment, spring lock 238 has a plurality of dual lock tangs as typified by dual lock tang 239. Dual lock tang 239 has a fine lock tang 202 and a coarse lock tang 204 as shown and operates as described hereinafter.

Figure 7:
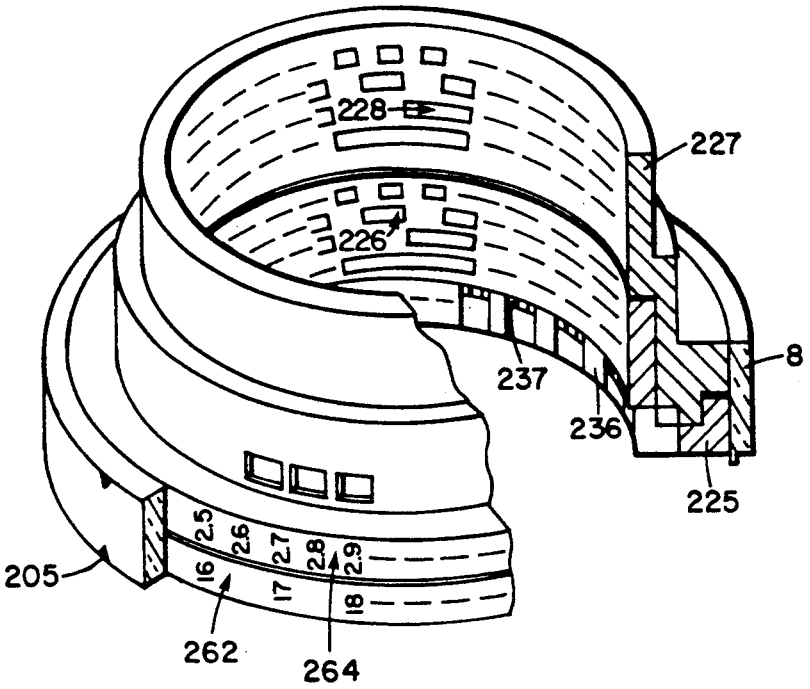
FIG. 7 is an isometric view of a section of an encoder according to the second embodiment of the invention.

Referring again to FIG. 6, spring lock 238 is shown when the vernier encoder ring 227 and the coarse encoder ring 225 are locked. When the lock pin 14 is released, the spring lock 238 is exerting pressure in a radially outward position such that dual lock tang 239 engages coarse locking teeth 236 (FIG. 7) and fine locking teeth 237 (FIG. 7). In said position, coarse encoder ring 225 and fine encoder ring 227 are secured from moving by dual lock tang 239.

When it is desirable to change the settings of the dual encoder 210, lock pin 14 is depressed radially inwardly so that spring lock 238 moves inwardly which disengages the plurality of dual lock tangs, including dual lock tang 239, from coarse locking teeth 236 and fine locking teeth 237. The latter allows a user (not shown) to rotate setting collar 9 which causes, as described hereinafter, coarse encoder ring 225 to rotate until a desirable position is selected using index 205 (FIG. 7).

Upon selecting a desired position for coarse encoder ring 225, lock pin 14 is partially released so that the plurality of dual lock tangs including dual lock tang 239 on spring lock 238 engages coarse locking teeth 236 while fine locking teeth 237 remain disengaged. The latter allows a user (not shown) to rotate setting collar 9, which causes, as described hereinafter, vernier encoder ring 227 to rotate until a desirable position is selected using index 205 (FIG. 7). Upon selecting a desired position for vernier encoder ring 227, lock pin 14 is completely released as shown so that the plurality of dual lock tangs including dual lock tang 239 engage coarse locking teeth 236 (FIG. 7) and fine locking teeth 237 (FIG. 7).

Figure 9:
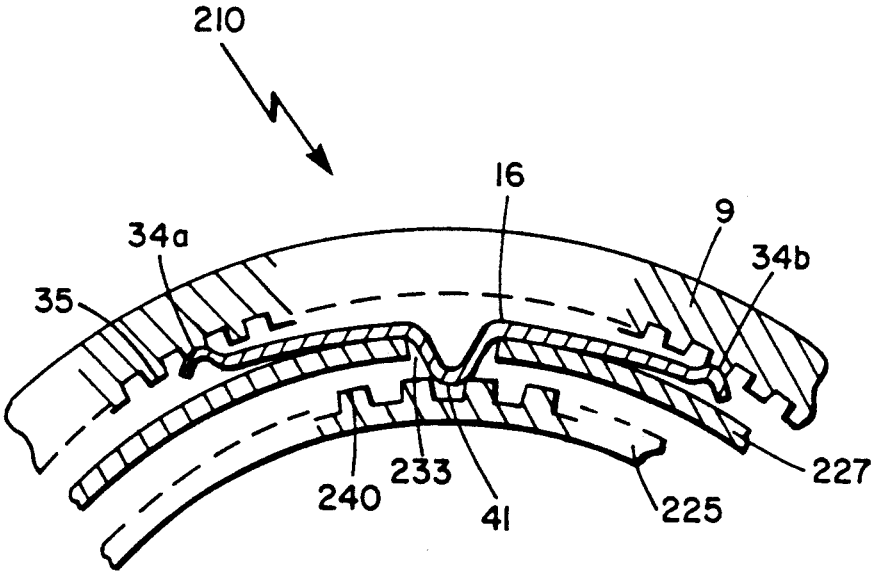
FIG. 9 is a cross-sectional view showing the detent spring cooperating with a vernier encoder ring, a coarse encoder ring and the setting collar according to the second embodiment of the invention.

Referring now to FIG. 9, detent spring 16, having spring ends 34*a* and 34*b*, is shown as used in the dual encoder 210. Slot 233 in vernier encoder ring 227 holds detent spring 16 in a fixed position relative to vernier encoder ring 227. When the coarse encoder ring 225 and the vernier encoder ring 227 are locked, spring ends 34*a* and 34*b* slip over reaction surface 35 of setting collar 9. When the coarse encoder ring 225 and the vernier encoder ring 227 are unlocked, detent spring 16 reacts with a reaction surface 240 of the coarse encoder ring 225 at spring point 41 of the detent spring 16 so that as the setting collar 9 is rotated, the coarse encoder ring 225 is rotated correspondingly. The vernier encoder ring 227 is also rotated by the latter. When the coarse encoder ring 225 is locked and the vernier encoder ring 227 is unlocked, spring point 41 of the detent spring 16 will slip over reaction surface 240 of the coarse encoder ring 225. Since the vernier encoder ring 227 is unlocked, the vernier encoder ring 227 is rotated as setting collar 9 is rotated until a desired position is selected at which time the vernier encoder ring 227 is locked. An inadvertent resetting of the fuze is prevented by the hereinabove described action.

Referring again to FIG. 6, it will now be apparent to one of skill in the art that the inward deflection of the lock pin 14 displaces spring lock 238, thereby disengaging the plurality of lock tangs (not shown) on spring lock 238 from the coarse locking teeth 236 (FIG. 7) and the vernier locking teeth 237 (FIG. 7). Rotation of the setting collar 9 causes the vernier encoder ring 227 and the coarse encoder ring 225, reacting through detent spring 16 (FIG. 9), to rotate. The setting collar 9 is rotated until the user (not shown), viewing through window 8 at index 205 (FIG. 7), selects a desired element of the coarse encoder setting 262. The foregoing action selected a corresponding element of the mask pattern (not shown) which actuated the plurality of actuators (not shown) which corresponds to the selected element of the coarse encoder setting 262 (FIG. 7). Partial release of the lock pin 14 will cause the plurality of lock tangs (not shown) to engage the coarse locking teeth 236 (FIG. 7) which locked the coarse encoder ring 225 while the vernier encoder ring 227 remains unlocked. The setting collar 9 is rotated further until the user (not shown), viewing through window 8 at index 205, selects a desired element of the vernier encoder setting 264. The foregoing action selected a corresponding element of the mask pattern (not shown) which actuated a plurality of actuators (not shown) which corresponded to the selected element of the vernier encoder setting 264. Releasing fully lock pin 14 caused the plurality of lock tangs (not shown) to engage the fine locking teeth 237 (FIG. 7) in addition to the coarse locking teeth 236 (FIG. 7), thereby locking the vernier encoder ring 227 in addition to the coarse encoder ring 225. Further rotation of the setting collar 9 will cause deflection of the spring ends 34*a* and 34*b* (FIG. 9) so that no reaction is allowed to transfer rotation to either the vernier encoder ring 227 or the coarse encoder ring 225.

Having described this invention, it will now be apparent to one of skill in the art that the number and disposition of the various locking teeth may be changed without affecting this invention. Further, the location and the number of detent springs could be changed to achieve different pressure. Also the type and number of actuators used to read the predetermined mask pattern could be changed. The invention could be used in all types of fuzes including proximity fuzes wherein delayed activation of the fuze is required. It is felt, therefore, that this invention should not be restricted to its disclosed embodiment, but rather should be limited only by the spirit and scope of the appended claims.

What is claimed is:

1. A time-delay mechanism comprising:

(a) a time-delay section having a rotatable element with a plurality of lands and grooves disposed on the rotatable element, and a plurality of switches, each one of the lands and grooves dimensioned to open or close, respectively, a corresponding one of the plurality of switches to provide a mechanical read only memory element, such time-delay section being adapted to convert angular position of the rotatable element to a corresponding distribution of settings of individual switches in the plurality of switches; and (b) a locking and unlocking section adjacent to the time-delay section, the locking and unlocking section being adapted alternatively to:

(i) inhibit, when in a locking mode, any change in the angular position of the rotatable element; and (ii) permit, when in an unlocking mode, a change in the angular position of the rotatable element.

2. A time delay mechanism as recited in claim 1 wherein said time delay mechanism further comprises:

(a) a predetermined mask pattern with a plurality of mask elements, each one of the plurality of mask elements provided from a portion of the plurality of lands and grooves;

(b) a setting collar with an inner wall having a reaction surface, the setting collar encircling a section of the rotatable element; and (c) a detent spring with a flange and a pair of spring ends, the spring ends engaged by the reaction surface of the setting collar and the flange meshed with the encoder ring so that as the setting collar is rotated, when the locking and unlocking section is in the unlocking mode, the detent spring and the rotatable element are rotated and when the lock and unlocking section is in the locking mode, the spring ends slip over the reaction surface.

3. A time delay mechanism as recited in claim 2 wherein said locking and unlocking section comprises:

(a) a lock pin with a control groove;
(b) a spring lock with a plurality of lock tangs and a recess, the recess engaged by the control groove of the lock pin; and
(c) a plurality of locking teeth disposed on the rotatable element so that a portion of the plurality of locking teeth is engaged by the plurality of lock tangs.

4. A time delay mechanism as recited in claim 3 wherein the setting collar comprises an outer surface with a plurality of flutes to facilitate positive gripping of the setting collar.

5. A time delay mechanism as recited in claim 4 further comprising:
(a) a window ring with an index mark, the window ring encircling a section of the rotatable element and located adjacent the setting collar; and
(b) a predetermined code having a plurality of code elements recorded on the periphery of the rotatable element, each one of the plurality of coded elements corresponding to one of the plurality of mask elements.

6. A time delay mechanism comprising:
(a) an encoder ring with a predetermined mask pattern having a plurality of mask elements, each mask element corresponding to one of a plurality of timing settings;
(b) means for locking the encoder ring at one of the plurality of mask elements,
wherein said locking means comprises:
(i) a lock pin with a control groove;
(ii) a spring lock with a plurality of lock tangs and a recess, the recess engaged by the control groove of the lock pin; and
(iii) a plurality of locking teeth disposed on the encoder ring so that the plurality of locking teeth is engaged by the plurality of lock tangs such that the encoder ring is locked at one of the plurality of mask elements; and
(c) means for selectively changing the encoder ring from being locked at one to another one of the plurality of mask elements.

7. A time delay mechanism as recited in claim 6 wherein said selectively changing means comprises:
(a) a setting collar with an inner wall having a reaction surface, the setting collar encircling a section of the encoder ring; and
(b) a detent spring engaged between the reaction surface of the setting collar and the encoder ring such that, as the setting collar is rotated, the encoder ring is rotated.

8. A time delay mechanism as recited in claim 7 wherein said selectively changing means further comprises a pair of spring ends disposed on the detent spring so that as the setting collar is rotated, when the encoder ring is locked by the locking means, the pair of spring ends slips over the reaction surface of the setting collar.

9. A time delay mechanism comprising:
(a) a coarse encoder ring having a predetermined mask pattern with a first plurality of mask elements, each one of the first plurality of mask elements indicative of a most significant bit of a plurality of digital words;
(b) a vernier encoder ring having a predetermined mask pattern with a second plurality of mask elements, each one of the second plurality of mask elements indicative of a least significant bit of the plurality of digital words;
(c) means for locking the coarse encoder ring and the vernier encoder ring at one of the respective plurality of mask elements; wherein said locking means comprises:
(i) a lock pin with a control groove;
(ii) a spring lock with a plurality of dual lock tangs and a recess, the recess engaged by the control groove of the lock pin, and each one of the plurality of dual lock tangs having a coarse lock tang and a fine lock tang;
(iii) a plurality of coarse locking teeth disposed on the coarse encoder ring so that a portion of the plurality of coarse locking teeth is engaged by the coarse lock tang of each one of the plurality of dual lock tangs so that the coarse encoder ring is locked at one of the first plurality of mask elements; and
(iv) a plurality of fine locking teeth disposed on the vernier encoder ring so that a portion of the plurality of fine locking teeth is engaged by the fine lock tang of each one of the plurality of dual lock tangs so that the vernier encoder ring is locked at one of the second plurality of mask elements; and
(d) means for selectively changing the coarse encoder ring and the fine encoder ring from one to another one of the respective plurality of mask elements.

10. A time delay mechanism as recited in claim 9 wherein said selectively changing means comprises:
(a) a setting collar with an inner wall having a reaction surface, the setting collar encircling a section of the vernier encoder ring; and
(b) a detent spring protruding through the vernier encoder ring and engaged between the reaction surface of the setting collar and the coarse encoder ring so that as the setting collar is rotated the coarse and the fine encoder rings are rotated.

11. A time delay mechanism as recited in claim 10 wherein the coarse encoder ring comprises an outer surface having a reaction surface and the selectively changing means further comprises:
(a) a pair of spring ends disposed on the detent spring so that, as the setting collar is rotated when the vernier encoder ring is locked by the locking means, the spring ends slip over the reaction surface of the setting collar; and
(b) a flange disposed on the detent spring extending through the vernier encoder ring and meshed with the reaction surface of the coarse encoder ring so that as the setting collar is rotated when the coarse encoder ring is locked by the locking means, the flange slips over the reaction surface of the coarse encoder ring.

* * * * *